United States Patent [19]

Thuries et al.

[11] Patent Number: 4,743,721

[45] Date of Patent: May 10, 1988

[54] CIRCUIT BREAKER ACTUATOR DEVICE

[75] Inventors: Edmond Thuries, Pusignan; Jean-Paul Masson, Villeurbanne; Michel Perret, Tramole, all of France; Satoru Yanabu, Tokyo, Japan

[73] Assignee: Alsthom, Paris, France

[21] Appl. No.: 17,420

[22] Filed: Feb. 24, 1987

[30] Foreign Application Priority Data

Feb. 21, 1986 [FR] France ..... 86 02409

[51] Int. Cl.[4] ..... H01H 5/04

[52] U.S. Cl. ..... 200/153 SC; 74/97

[58] Field of Search ..... 200/153 SC; 267/73, 267/69, 166; 74/97

[56] References Cited

U.S. PATENT DOCUMENTS 2,544,811 3/1981 Straub ..... 74/97
2,972,259 2/1961 Favre ..... 200/153 SC
3,144,296 8/1964 Höhl ..... 74/97

FOREIGN PATENT DOCUMENTS 708191 4/1954 United Kingdom .
237947 7/1969 U.S.S.R. ..... 200/153 SC

*Primary Examiner*—Renee S. Luebke
*Attorney, Agent, or Firm*—Sughrue, Mion, Zinn, Macpeak & Seas

[57] ABSTRACT

A circuit breaker actuator device of the type comprising an operating wheel (R) whose rotation drives the moving circuit-breaking members, said wheel being connected to a first spring (S'1) by a first chain (C1) passing over a first pulley (P1) and fixed to a first point (A1) close to the periphery of the wheel. The wheel is held fixed when the spring (S1) is under tension/compression by means of a retaining member (K1) which can be retracted to allow the wheel to rotate. The device further includes a second spring (S2) connected by a second chain (C2) passing over a second pulley (P2) and fixed to a second point (A2) on said wheel. The center of the wheel is situated, when both springs are under tension/compression, between the length of the first chain connecting the first point to the first pulley and the length of the second chain connecting the second point to the second pulley, with the second spring applying a force which is less than the force applied by the first spring.

5 Claims, 2 Drawing Sheets

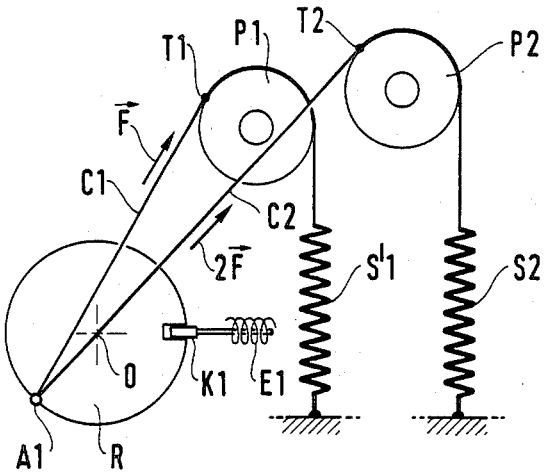
FIG.4
FIG.5
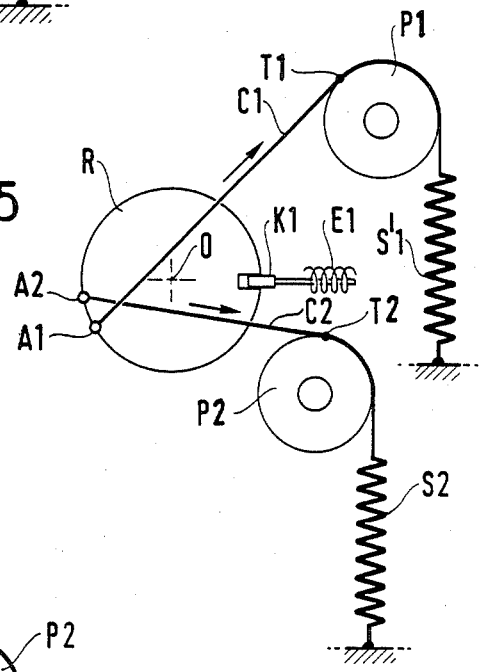
FIG.6
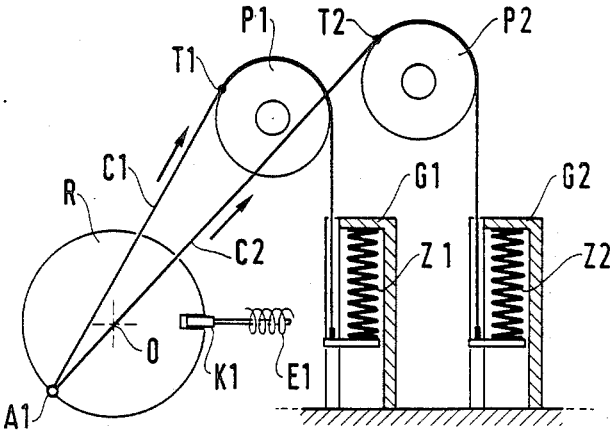

CIRCUIT BREAKER ACTUATOR DEVICE

The present invention relates to a circuit breaker actuator device of the type comprising an operating wheel whose rotation causes the moving circuit-breaking members of the circuit breaker to be displaced. In this type of actuator device a chain (or a cable) is fixed to a point close to the periphery of the wheel. The chain passes over a pulley and is fixed at a first end to a spring whose other end is fixed to a fixed point.

BACKGROUND OF THE INVENTION

One such device is described in British Pat. No. 708,191, and in French Pat. No. 1,588,485.

Rotating the wheel through a certain angle puts the spring under tension, thereby storing energy for subsequent use in operating the circuit breaker.

A restraining member holds the wheel in its fixed position when the spring is under tension.

Generally, an electromagnet is used to act on the restraining member when the circuit breaker is operated in order to release the wheel. One or more force multiplying stages may be interposed between the restraining member and the electromagnet. This makes it possible to use a small electromagnet actuated by a low control current.

The retaining member and the force-multiplying stage(s) are mechanical parts which are difficult and costly to develop and/or adjust.

With increasing values of the currents to be interrupted by circuit breakers, it is necessary to use circuit breakers having mechanical controls of increasing power, and thus requiring springs which are more powerful or more numerous.

The force exerted by the wheel on the restraining system is therefore increased, and as a result more force is required to release the wheel.

An aim of the present invention is to provide an actuator device which, while providing increased operating energy, is nevertheless capable of using the same retaining members, force-multiplying stages, and electromagnets as used by lower power actuator devices.

This problem is not solved in the above-cited documents.

SUMMARY OF THE INVENTION

The invention provides a circuit breaker actuator device of the type comprising an operating wheel whose rotation drives the moving circuit-breaking members, said wheel being connected to a first spring by a first chain passing over a first pulley and fixed to a first point close to the periphery of said wheel, the wheel being held fixed when the spring is loaded by means of a retaining member which can be retracted to allow the wheel to rotate, the device further including a second spring connected by a second chain passing over a second pulley and fixed to a second point on said wheel, the center of said wheel being situated, when both springs are loaded, between the length of the first chain connecting the first point to the first pulley and the length of the second chain connecting the second point to the second pulley, with the second spring applying a force which is less than the force applied by the first spring.

BRIEF DESCRIPTION OF THE DRAWINGS

The invention is described in greater detail in the following description of several embodiments of the invention, made with the reference to the accompanying drawings, in which:

FIG. 4 is a diagram of a second embodiment of an actuator device in accordance with the invention;

FIG. 5 is a diagram of a third embodiment of an actuator device in accordance with the invention; and FIG. 6 is a diagram of a variant actuator device in accordance with the invention.

MORE DETAILED DESCRIPTION

Figure 1:
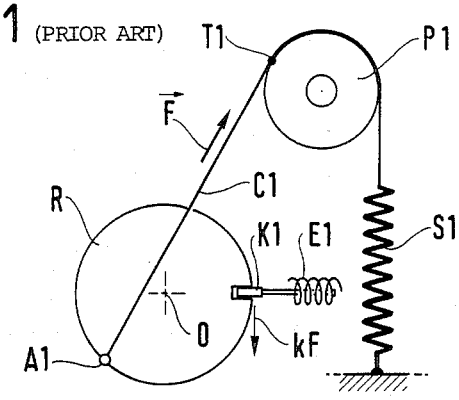
FIG.1 (PRIOR ART)
FIG. 1 is a diagram for explaining the structure and operation of a prior art actuator device.

FIG. 1 is a diagram of a prior art circuit breaker drive device.

It includes a wheel R rotating about an axis O.

A chain C1 is fixed to a point A1 close to the periphery of the wheel and passes via a pulley P1 to be fixed to a spring S1. A retaining member K1 under the control of an electromagnet E1 holds the wheel in a fixed position while the spring is under tension. The force-multiplying stages are not shown.

If the spring force is equal to F, the force exerted on the retaining system is proportional thereto, i.e. kF.

The technical problem faced by the Applicant is to construct a circuit breaker for 145 kV or more using components that already exist for controlling a 72 kV circuit breaker. However, it is essential to provide a greater operating energy. If the greater operating energy is obtained by using a more powerful spring, for example providing a force 2F, the force exerted on the retaining system will be 2kF thus requiring a more powerful electromagnet and possibly an additional force-multiplying stage.

Figure 2:
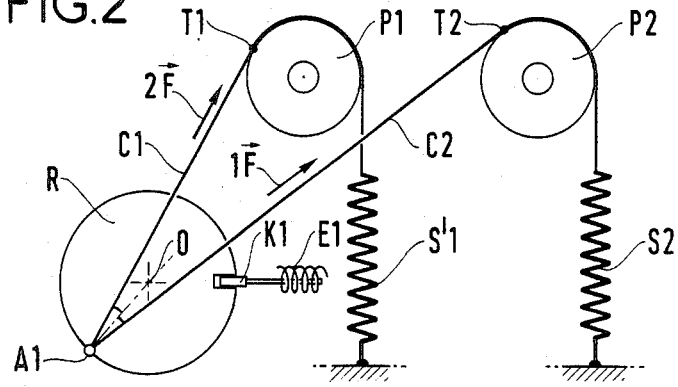
FIG. 2 is a diagram of an actuator device in accordance with a first embodiment of the invention and shown in its rest position with the springs under tension.
Figure 3:
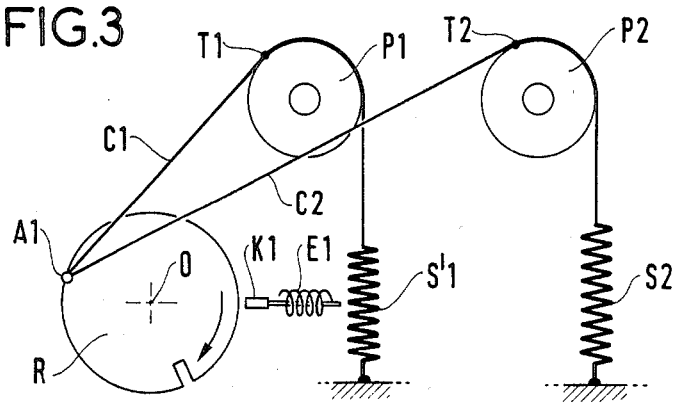
FIG. 3 is a diagram of the FIG. 2 actuator device in operation.

This drawback is avoided with an actuator device in accordance with the invention, and a first embodiment thereof is shown in FIGS. 2 and 3.

In the prior art device comprising the wheel R, the spring S1, the chain C1, and the pulley P1, the spring S1 is replaced by a spring S'1 exerting a force F'1, e.g. equal to 2F.

A second spring S2 is also added to the device, providing a force equal to F, and connected to the point A1 by a chain C2 passing over a pulley P2.

In accordance with the invention, the lengths of chain A1T1 extending from the point A1 to the pulley P1, and A1T2 extending from the point A1 to the pulley P2, are situated on opposite sides of the axis O of the wheel when the springs S1 and S2 are under tension. Preferably, as shown in FIG. 2, A1T1 and A1T2 are at equal angles to the radius A1-O. Thus, the tangential force exerted on the wheel, and hence the retaining force remains equal to kF.

Once the retaining means are released, the spring S'1 rotates the wheel against the action of the spring S2 with a force F as in the case shown in FIG. 1. As soon as the length of chain A1T2 leaves the other side of the point O relative to the length A1T1, the spring S2 participates in driving the wheel and the wheel drive force becomes $2F+F=3F$ (see FIG. 3).

The above-described device is equally applicable to the mechanism for engaging a circuit breaker as to the mechanism for disengaging a circuit breaker.

FIG. 4 shows a variant embodiment. The component parts are the same as those shown in FIGS. 2 and 3 and they have been given the same reference numerals.

The springs are shown under tension, with the device being at rest.

The difference compared with FIG. 2 is that the length A1T1 passes through the axis O of the wheel. The force 2F of the spring S2 is counter-balanced by the reaction of the wheel bearings about the axis O. The force exerted on the retaining member is thus equal to the force exerted by the devices shown in FIGS. 1 to 3. However, unlike the FIG. 2 device, as soon as the retaining member K1 is released, the spring S2 starts driving the wheel and its effect is added to that of the spring S'1.

The invention is not limited to the embodiments described and shown.

It is possible, as shown in FIG. 5 which represents a generalization of the principle of the invention, to connect the length C2 to a point A2 on the periphery of the wheel R which is close to the point A1 but not the same as the point A1. The spring forces may be selected over a wide range, and the only conditions that need to be satisfied are that the force from the spring S'1 should be greater than the force from the spring S2, and that the lengths A1T1 and A2T2 should be disposed relative to the wheel axis O in such a manner as to satisfy two requirments:

sufficient overall circuit breaker operating force; and a force on the retaining member which remains below a given value.

Naturally, the invention is applicable not only to traction springs (as shown in FIGS. 2 to 5), but also to compression springs.

FIG. 6 shows a variant of the FIG. 4 device in which the traction springs S'1 and S2 are respectively replaced by compression springs Z1 and Z2 placed in cylinders G1 and G2.

We claim:

1. A circuit breaker actuator device for actuating a circuit breaker having moving circuit breaker members, said device comprising an operating wheel mounted for rotation about its axis whose rotation drives said moving circuit-breaking members, said wheel being connected to a first spring by a first chain passing over a first pulley and fixed to a first point close to the periphery of said wheel, a retractable retaining member engaging said wheel periphery to hold the wheel fixed when the spring is loaded by means of said retaining member which is retracted to allow the wheel to rotate, said device further including a second spring connected by a second chain passing over a second pulley and fixed to a second point on said wheel, the center of said wheel being situated, when both springs are loaded, between a length of the first chain connecting the first point to the first pulley and a length of the second chain connecting a second point to the second pulley, and wherein the second spring applies a force which is less than the force applied by the first spring, whereby once the retaining means are released, the first spring rotates the wheel against the action of the second spring until the second length of chain passes to the other side of the center of the wheel whereby the second spring participates in driving the wheel along with the first spring so that its driving force is added to that of the first spring.

2. A device according to claim 1, wherein the chain connection points on the wheel are constituted by a single point.

3. A device according to claim 2, wherein the force of the first spring is substantially equal to twice the force of the second spring.

4. A device according to claim 2, wherein the difference between the force of the first spring and the force of the second spring is a force of sufficient value to operate the circuit breaker.

5. A device according to claim 2, wherein the length of the second chain connecting the second spring to the wheel passes through the axis of the wheel.

* * * * *